US007544617B1

(12) United States Patent
Chandra et al.

(10) Patent No.: US 7,544,617 B1
(45) Date of Patent: Jun. 9, 2009

(54) DIE SCALE CONTROL OF CHEMICAL MECHANICAL POLISHING

(75) Inventors: Abhijit Chandra, Ames, IA (US); Muthukkumar Kadavasal, Ames, IA (US); Sutee Eamkajornsiri, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 0 days.

(21) Appl. No.: 11/426,083

(22) Filed: Jun. 23, 2006

Related U.S. Application Data

(60) Provisional application No. 60/694,904, filed on Jun. 29, 2005.

(51) Int. Cl.
*H01L 21/461* (2006.01)

(52) U.S. Cl. ..... 438/691; 438/14; 438/437; 438/634; 438/696

(58) Field of Classification Search ..... 438/691, 438/696, 634, 437, 14
See application file for complete search history.

(56) References Cited

U.S. PATENT DOCUMENTS

2004/0074599 A1* 4/2004 Kneer ..... 156/345.1
2004/0259472 A1* 12/2004 Chalmers et al. ..... 451/5

OTHER PUBLICATIONS

Bastawros, Ashraf et al. "Pad Effects on Material-Removal in Chemical-Mechanical Planarization"; Journal of Electronic Materials, vol. 31, No. 10, 2002; Special Issue Paper 1022.

Eamkajomsiri, Sutee, et al., "Model Based Control of Wafer Scale Variation During the CMP Process" Sep. 2002—5 pages.

Eamkajomsiri, Sutee, et al., "Model Based Control of Wafer Scale Variation During the CMP Process", Sep. 2002, 30 pages.

Eamkajomsiri, Sutee, et al., "Yield Improvement in Wafer Planarization: Modeling and Simulation" Journal of Manufacturing Systems: 2003; 22, 3; pp. 239-247.

Eamkajomsiri, Sutee, "Yield Improvement in Chemical Mechanical Polishing Process Investigation of Wafer Scale" Program of Study Committee, Iowa State University, 2002; 105 pages.

Eamkajomsiri, Sutee, et al., "Simulation of Wafer Scale Variations in Chemical Mechanical Polishing" Department of Industrial & Manufacturing Systems Engineering, Iowa State University, NAMRC 2001; 9 pages.

(Continued)

*Primary Examiner*—Nadine G Norton
*Assistant Examiner*—Mahmoud Dahimene
(74) *Attorney, Agent, or Firm*—McKee, Voorhees & Sease, P.L.C.

(57) ABSTRACT

A method for control of chemical mechanical polishing of a pattern dependant non-uniform wafer surfaces in a die scale wherein the die in the wafer surface have a plurality of zones of different heights and different pattern densities is provided. The method provides for varying pressure applied to the die both spatially and temporally to reduce both local and global step height variations. In one embodiment, pressure is varied both spatially and temporally using a look ahead algorithm. The algorithm looks ahead and recalculates/modifies the pressure values by identifying the step heights that could be formed after a specified time step. The final surface predictions have improved uniformity on the upper surface as well as on the step heights across the entire die.

12 Claims, 12 Drawing Sheets

OTHER PUBLICATIONS

Fu, Guanghui et al., "A Model for Wafer Scale Variation of Material Removal Rate in Chemical Mechanical POlishing Based on Viscoelastic Pad Deformation", Journal of Electronic Materials, vol. 31, No. 10, 2002; pp. 1066-1073.

Sun, Hongwei et al. Characterization and Modeling of Wafer and Die Level Uniformity in Deep Reactive Ion Etching (DRIE); Mat. Res. Soc. Symp. Proc. vol. 782, 2004 Materials Research Society; pp. A10.2.1-6.

* cited by examiner

Spatial and Temporal pressure control – Flowchart

Look ahead scheduled pressure control – Flowchart

DIE SCALE CONTROL OF CHEMICAL MECHANICAL POLISHING

RELATED APPLICATIONS

This application claims priority to U.S. Provisional Patent Application No. 60/694,904, filed Jun. 29, 2005, herein incorporated by reference in its entirety.

GRANT REFERENCE

The work presented in this application was supported in part by a federal grant (NSF Grant No. DMI-0323069), the government may have certain rights in this invention.

BACKGROUND OF THE INVENTION

Achieving local as well as global planalization is one of the prime requirements in micro fabrication methods. Many different methods of dielectric planarization are practiced in order to achieve local and global planarity. Chemical mechanical polishing (CMP) has emerged as the planarization method of choice [Li, 2000] because of its ability to planarize over longer length scales than traditional planarization techniques and is considered to provide far better local and global planarization [Steigerwald, et al 1997, Sivaram et al 1992, Patrick et al 1991]. Besides interlayer dielectric planarization, CMP has also find applications in shallow trench isolation, damascene technologies [e.g., Kaanta 1991, Kranenberg 1998]. Despite the advantages that CMP enjoys, the process still suffers from large global non-uniformities within a die and across a wafer. FIGS. 1A and 1B show a pictorial view of a CMP machine set-up. In FIG. 1A, a top view of a table or platen 10 and its associated polishing pad with a wafer carrier 14 mounted on a rotatable axis 12. FIG. 1B illustrates a side view showing the wafer carrier and wafer 14 adjacent the polishing pad of the table 10 which is mounted on a rotatable axis 16. Machines with multiple heads are also available. In a typical dielectric polishing process, the wafer is held by a rotating carrier 14 with the active wafer surface facing the rotating polish table (platen 10). On top of the table 10 is a porous polyurethane pad on which, slurry of colloidal silica suspended in aqueous solution is poured. Slurries with different chemical compositions are used to polish metal and other films. In a typical configuration, the carrier and table rotate in the same direction but with the two rotating axes offset by some distance. The carrier also exhibits an orbital motion.

The arrangement results in relative motion between any position on the wafer and the polishing pad. The slurry chemically reacts with the wafer surface and together with the mechanical force exerted by the pad and the colloidal silica particles; the wafer surface is abraded [Cook, 1990]. The material removal also relies on the relative motion between the wafer and pad surface. The pad surface becomes glazed over time, resulting in a lower polish rate. A diamond tipped conditioner minimizes this effect by scratching the surface of the pad thus maintaining its polishing efficiency.

Although CMP can planarize over longer length scales, pattern density variation across a chip leads to large variation in global thickness across the die. CMP therefore removes local steps but generates global steps as illustrated in FIG. 2. Due to the initial pattern density difference, the two regions on a chip polish at different rates. At some time $T_1$, local planarity is achieved in the low density area of density $PD_1$. After some time $T_2$, local planarity is also achieved in the high density region of initial density $PD_2$. The initial difference in layout pattern density creates a global step height between these two regions due to the difference in removal rates before the local patterns are planarized. [Ouma, 1998] Although the global thickness variation is no longer a serious lithography concern, it still has a serious impact on subsequent process steps such as via etching. Depending on the location of the via, the depth will be different thus making it difficult to determine a suitable etch time. The global thickness variation also impacts circuit performance: long-range clock wires passing through regions of different thicknesses result in different capacitances and may result in clock skew [Stine et al 1997]. The length scale over which complete local planarity is achieved is a function of the elastic properties of the polish pad and other process conditions. This length scale is easily visualized by polishing a step density pattern. As shown in FIG. 3, away from the density boundary, local planarity is achieved.

Even though many publications have been made on the various modeling techniques in CMP to achieve global planarity, using material removal control techniques, pad property variation etc., not many concentrate on obtaining global planarity over pattern dependant surfaces. Most of them assume a uniform pattern density across the entire polish span. Eamkajornsiri et al [2001] concludes that yield improvement in CMP can be improved considerably by varying the interface pressure, wafer curvature and polishing time, in wafer scale, it doesn't taken into account the variation in pattern density across the die. Tugbawa et al [2001] proposes a contact mechanics based density step height model of pattern dependencies for predicting thickness evolution. Ouma et al [2002], provides a model using a 2 step FFT of the incoming wafer surface and an elliptic weighting function corresponding to pad deformation profile to obtain estimates of effective pattern densities across the entire wafer.

Therefore, it is a primary object, feature, or advantage of the present invention to improve over the state of the art.

It is a further object, feature, or advantage of the present invention to obtain local and global planarity in dielectric and metal planarizations in variable pattern density surfaces.

A further object, feature, or advantage of the present invention is to provide improved uniformity in step height across the die.

One or more of these and/or other objects, features, or advantages of the present invention will become apparent from the specification and claims that follow.

BRIEF SUMMARY OF THE INVENTION

Obtaining local and global planarity is one of the prime criteria in dielectric and metal planarizations. Although Chemical Mechanical Planarization (CMP) helps us achieve this criterion in constant pattern density surfaces, the same does not happen with variable pattern density surfaces, resulting in formation of global step heights across the die. The present invention provides a pressure controlled open loop algorithm to obtain planarity across a pattern dependent die. Based on the variation of pattern density and surface heights across the die, the surfaces are separated into zones and the pressure is varied spatially as well as temporally to obtain uniform surface heights, with enhanced step height uniformity. The algorithm looks ahead and recalculates/modifies the pressure values by identifying the step heights that could be formed after a specified time step. The final surface predictions have improved uniformity on the upper surface as well as on the step heights across the entire die. The simulation assists in tracking the polishing process for each time step and guide us with the exact pressure values to be applied such that the final surface is more uniform.

According to one aspect of the present invention, a method for control of chemical mechanical polishing of a pattern dependant non-uniform wafer surfaces in a die scale is provided. The die in the wafer surface has a plurality of zones of different heights and different pattern densities. The method provides for varying pressure applied to the die both spatially and temporally to reduce both local and global step height variations. The manner in which pressure is varied may use a look-ahead scheduling algorithm. The manner in which pressure is varied may include calculating the pressures for each zone and comparing with step heights for each zone or potential step heights of each zone after a specified time step. In addition, the method may further vary velocity, temperature profile, voltage, and/or current.

According to another aspect of the present invention, a method is provided for spatial pressure control of chemical mechanical polishing of a pattern dependant non-uniform wafer surfaces in a die scale wherein the die in the wafer surface have a plurality of zones of different heights and different pattern densities. The method includes determining total material to removed in all zones together, determining polishing time needed for each zone to reach the desired surface with maximum interface pressure, comparing the polishing time for all zones and finding maximum polishing time needed to have all applied interface pressure values of all zones to be less than or equal to a maximum interface pressure, polishing of the wafer surface for the polishing time.

According to another aspect of the present invention, a method for control includes determining a smallest step height for each of the zones, determining a maximum pressure for each of the zones, determining an interface pressure for each zone, polishing of the wafer surfaces until the smallest step height is reached, and applying a spatial pressure algorithm.

According to another aspect of the present invention, a method includes varying pressure applied to the die both spatially and temporally to reduce both local and global step height variations and varying at least one additional variable between a pad and the wafer surface, the at least one additional variable selected from the set consisting of velocity, temperature profile, voltage, and current.

DETAILED DESCRIPTION OF THE PREFERRED EMBODIMENTS

Figure 1A:
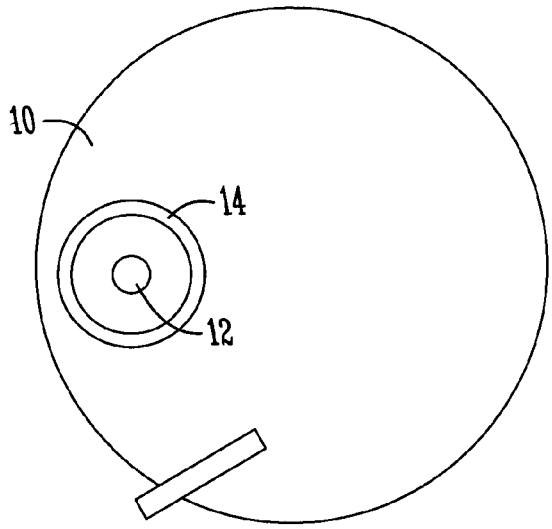
Fig. 1A (PRIOR ART)
FIG. 1A is a top view of a CMP process.
Figure 1B:
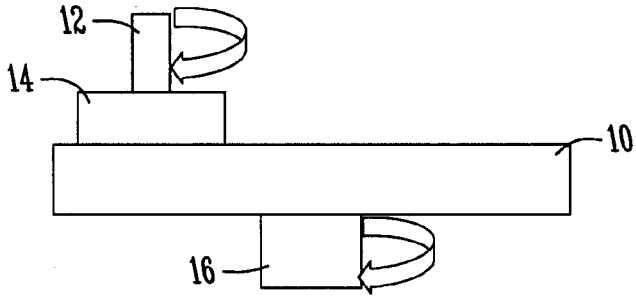
Fig. 1B (PRIOR ART)
FIG. 1B is front view of a CMP process.

Based on the effective pattern density in a region, and utilizing the step height reduction model developed by Fu et al [2003], one embodiment of the present invention provides a control based open loop algorithm to obtain uniformity over the pattern dependant non uniform wafer surfaces in a die scale. In this embodiment of the present invention, it is assumed that the die in the wafer surface has 'n' number of zones of different heights and different pattern densities. In order to minimize both local and global step height variations, the applied pressure is varied both spatially and temporally. A 2D simulation process is devised using a software development tool such as MICROSOFT VISUAL BASIC to track the amount of removal, and current step heights for every time step.

The Fu et al paper [2003] has the following assumptions: 1. Pad is assumed to deform like an elastic foundation 2. Force redistribution due to pad bending is proportional to dishing height 3. The material removal rate for metal interconnects and dielectric material follows Preston's equation [Preston, 1927] with different Preston's constants. 4. Wafer and pad are in contact at any point of the interface.

Notations Used

| | |
|---|---|
| $Y_{upper}$ | current height of the upper surface |
| $Y_{lower}$ | current height of the lower surface |
| D(t) | step height |
| P | Interface pressure |
| V | relative velocity |
| K | Preston's constant |
| k | Stiffness |
| a | Linewidth |
| b | Pitch |
| c | b − a |
| $\alpha$ | Bending factor |
| a/b | Pattern density |

The model provides and expression for the step height as a function of time, assuming the selectivity to be 1 and that there exists an upper and lower surface. The expression is as follows $$D(t) = [Y_{upper}(0) - Y_{lower}(0)]\exp\left\{-K\left[1 + \frac{\alpha}{k}\left(\frac{1}{a} + \frac{1}{c}\right)Vkt\right]\right\} \quad (1)$$

The final heights of the upper surfaces and lower surfaces for any time t is expressed as follows $$Y_{lower}(t) = \frac{\left(\frac{c}{b} + \frac{\alpha}{ka}\right)Y_{upper}(0) + \left(\frac{a}{b} + \frac{\alpha}{kc}\right)Y_{lower}(0)}{1 + \frac{\alpha}{k}\left(\frac{1}{a} + \frac{1}{c}\right)} - KPVt + \frac{\frac{c}{b} + \frac{\alpha}{ka}}{1 + \frac{\alpha}{k}\left(\frac{1}{a} + \frac{1}{c}\right)}[Y_{lower}(0) - Y_{upper}(0)]\exp\left\{-K\left[1 + \frac{\alpha}{k}\left(\frac{1}{a} + \frac{1}{c}\right)\right]Vkt\right\} \quad (2)$$

$$Y_{upper}(t) = \frac{\left(\frac{c}{b} + \frac{\alpha}{ka}\right)Y_{upper}(0) + \left(\frac{a}{b} + \frac{\alpha}{kc}\right)Y_{lower}(0)}{1 + \frac{\alpha}{k}\left(\frac{1}{a} + \frac{1}{c}\right)} - KPVt + \frac{\frac{a}{b} + \frac{\alpha}{ka}}{1 + \frac{\alpha}{k}\left(\frac{1}{a} + \frac{1}{c}\right)}[Y_{upper}(0) - Y_{lower}(0)]\exp\left\{-K\left[1 + \frac{\alpha}{k}\left(\frac{1}{a} + \frac{1}{c}\right)\right]Vkt\right\} \quad (3)$$

The removal rate equations being $$\frac{dY_{upper}}{dt} = KVk\left[\left(-\frac{a}{b} - \frac{\alpha}{kc}\right)(Y_{upper} - Y_{lower}) - \frac{P}{k}\right] \quad (4)$$

$$\frac{dY_{lower}}{dt} = KVk\left[\left(-\frac{c}{b} + \frac{\alpha}{ka}\right)(Y_{upper} - Y_{lower}) - \frac{P}{k}\right] \quad (5)$$

The equations 2 and 3 are terminal equations, meaning the values are the final heights after polishing for a given period of time. The equations 4 and 5 are intermediate equations, meaning the removal rate changes for every time step "dt" and so is the step height.

Figure 1C:
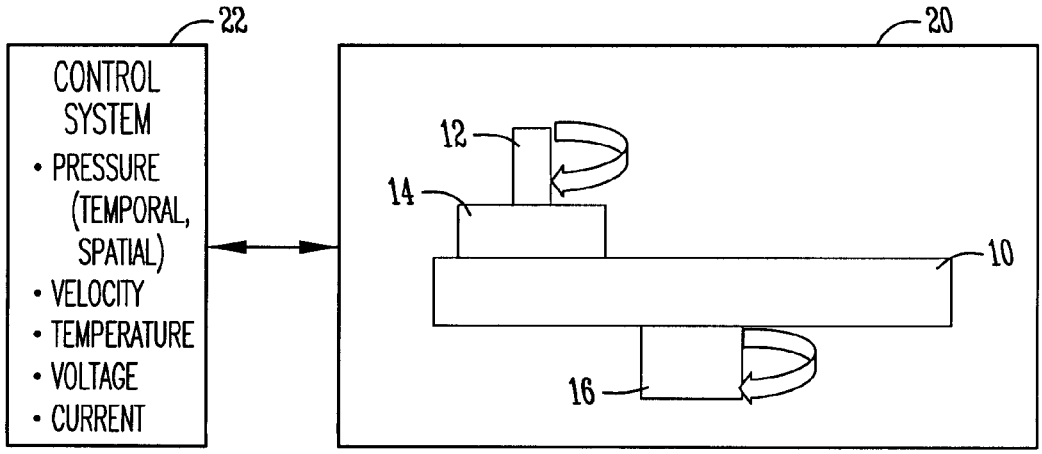
FIG. 1C is a block diagram illustrating a CMP setup with a control system adapted for performing the methodologies of the present invention.
Figure 2:
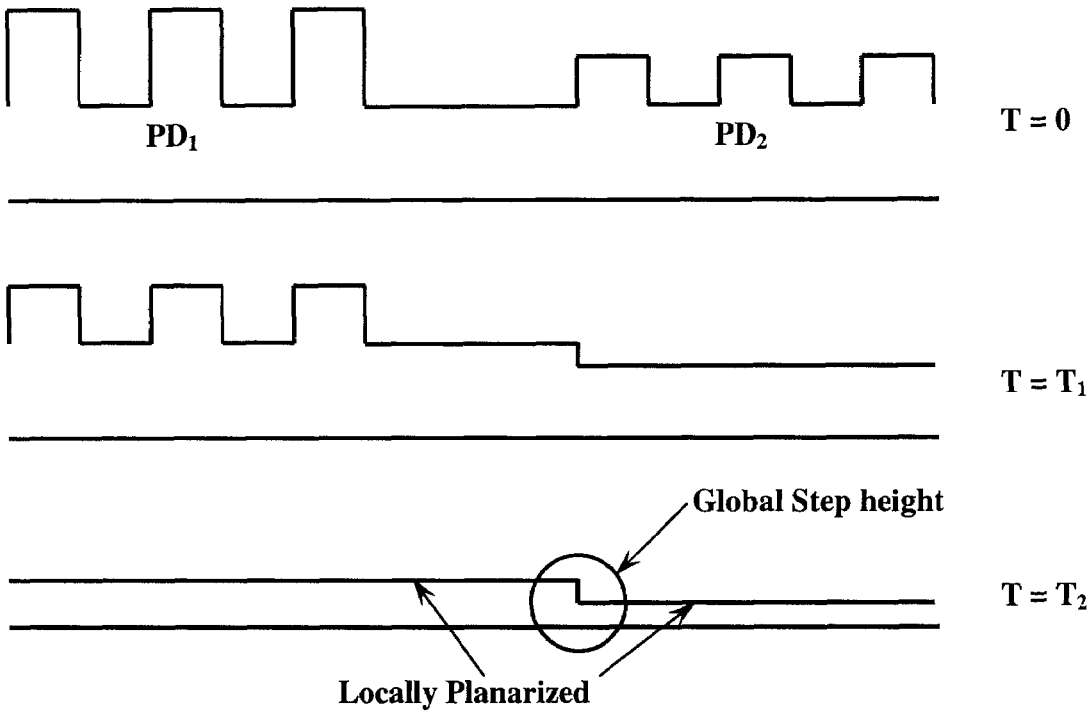
FIG. 2 illustrates planarization defects due to pattern density variations.
Figure 3:
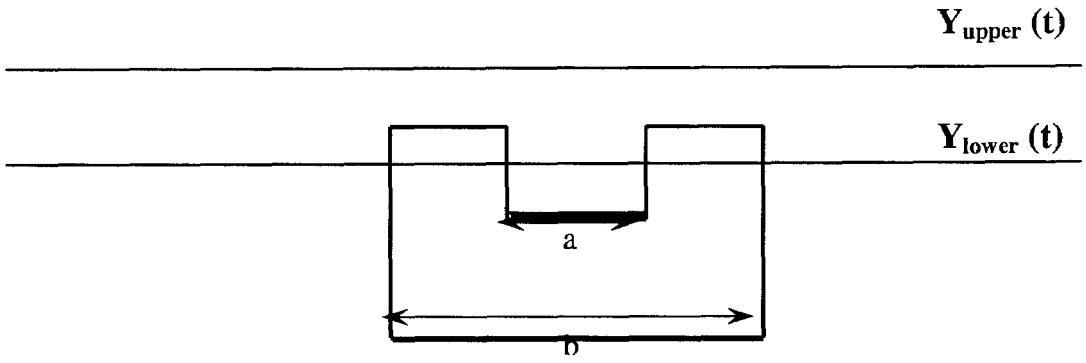
FIG. 3 is a schematic representation of a pattern.

The present invention provides for obtaining uniformity over pattern dependencies in a die-scale model. FIG. 1C illustrates a CMP setup 20 operatively connected to a control system 22 which assists in providing uniformity over pattern dependencies in a die-scale model. The control system 22 is adapted to provide for controlling the CMP setup 20, including pressure control. The pressure control can be spatial pressure control, temporal pressure control, or a combination of spatial and temporal pressure control. In addition, the control algorithm used may provide for look ahead scheduling. In addition, the control algorithm may take into account other parameters such as velocity, temperature profile, voltage, and current in controlling the CMP equipment. The control system 22 may include a computer, processor, microcontroller, integrated circuit, or other intelligent control capable of controlling the CMP setup 20. The control algorithms may be implemented in hardware or software.

It is these control algorithms which improve uniformity over the pattern dependencies in a die scale model. The first method described is the spatial pressure control method. The second method described is the spatial and temporal pressure control method. The third method described is a look-ahead scheduled pressure control method which reduces the frequency of changes in pressure by looking ahead. After each method has been described, simulation results are provided for each.

Spatial Pressure Control Method

The principle idea behind this pressure control is to planarize the upper surface of each zone, with different initial surface topography, down to a specific target surface at the best possible time. In order to achieve this goal, maximum pressure capability for a specific CMP machine will be applied to calculate the polishing time needed for each zone. This process allows us to specify time required to planarize every zone down to the same level. Applied interface pressures will then be calculated based on specified time in the earlier process. To achieve the specific target surface, the calculated pressure will be applied simultaneously throughout the entire period of polishing time. This strategy is calculated using the algorithm of FIG. 14 for each of n zones. The algorithm is as follows:

Step 100. The algorithm starts.

Step 102. All variables are input for each zone. This includes a, b, $Y_{upper}$, and $Y_{lower}$.

Step 104. Calculate the total material (Mat_Total) to be removed in all zones together. This step and step 112 are used together to find when the polishing process will finish. One example of an expression which can be used to calculate total material is:

$$\text{Mat_Total} = \sum_{i=1}^{n} (Y_{upper}(i) - Y_{desired})$$

Where, $Y_{desired}$ is the desired height, and $Y_{upper}$ is the initial upper surface height.

Step 106. Calculate the polishing time needed for each zone ($T_{zone}$) to reach the target or desired surface with the maximum interface pressure (the maximum pressure that the user would like to apply) using equation 3 by following the Newton-Raphson method. One example of an expression which can be used for calculating the time for each zone is:

$$t_{i+1} = t_i - f(t)/f'(t) \text{ until } t_{i+1} - t_i < 1e-8$$

Step 108. Compare the polishing time for all n zones and find the maximum polishing time needed to have all applied interface pressure values of all zones to be less than or equal to maximum interface pressure that we set. One example of an expression that can be used for the maximum polishing time needed is:

$$T_{max} = \text{Max}(T_{zone}), \text{ For zone=1 to n}$$

With polishing time as the $T_{max}$, the applied interface pressure for each zone is calculated using equation 3.

Step 110. Calculate Step Height and Check. Next the new upper and lower surface of each zone is calculated using the removal rate equation. With the calculated pressure allow polishing for the stipulated time $T_{max}$ on all 'n' zones, the step height is calculated. To calculate the step height, the new upper and lower surface of each zone are calculated as follows:

$$Y_{upper}(i)^{new} = Y_{upper}(i)^{old} - Y'_{upper}(i)\Delta t, \quad \text{for } i=1 \text{ to } n \text{ (\# of zones)}$$

$$Y_{lower}(i)^{new} = Y_{lower}(i)^{old} - Y'_{lower}(i)\Delta t, \quad \text{for } i=1 \text{ to } n \text{ (\# of zones)}$$

Where $\Delta t=0.1$ sec

After the step height is calculated, a check is performed. The check is performed by comparing the total material left with the previous step till it reaches the least total material left. If it is not, go back to step 110 and continue polishing and calculate the new upper and lower surface again.

Step 112. Next the error of upper surface of each zone is calculated. The below expression may be used:

$$\text{Error}_{upper}=(Y_{upper}(\text{final})_i-Y_{desired})/(Y_{upper}(0)_i-Y_{desired})\times 100$$

Step 114. The algorithm also provides for keeping tracking. This includes recording the initial variables (a, b, $Y_{upper}$, $Y_{lower}$), applied interface pressure, total time, and the final variables ($Y_{upper}$, $Y_{lower}$).

Step 116. Stop. The algorithm stops, the method complete.

Spatial and Temporal Pressure Control Method

Figure 14:
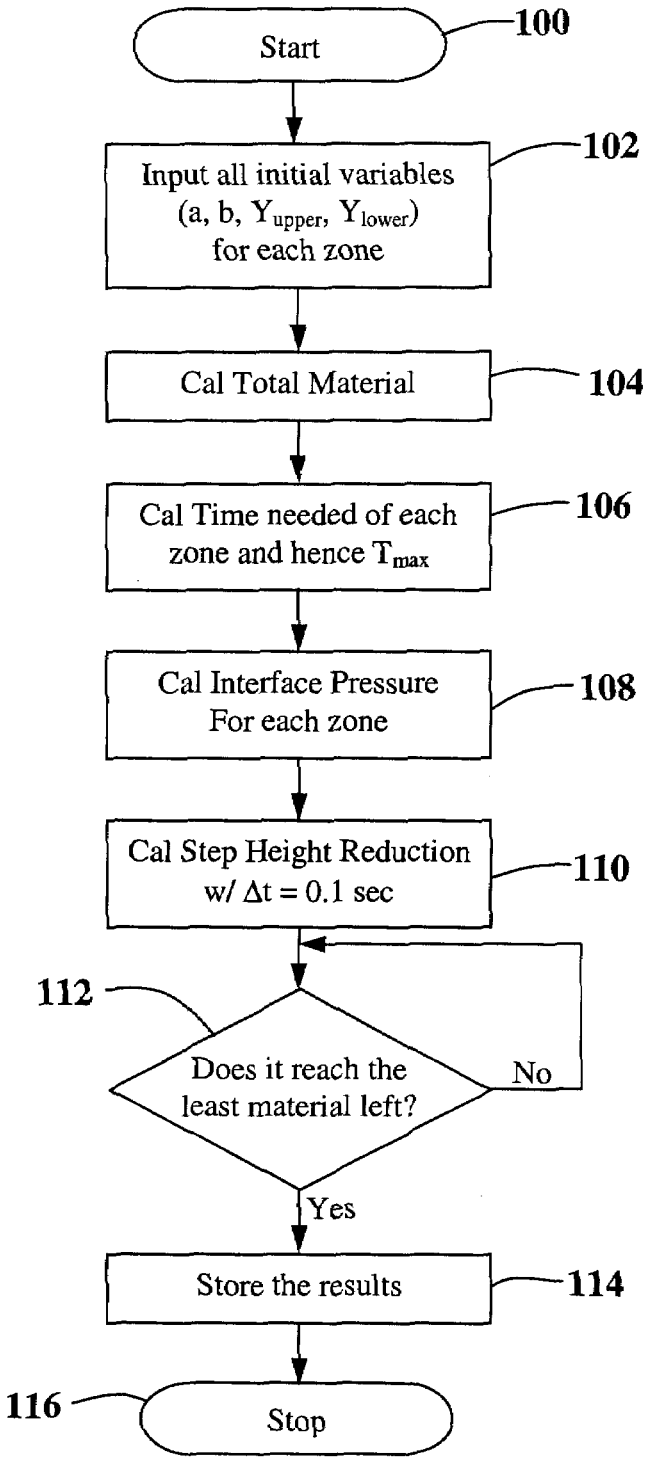
FIG. 14 is a flow chart illustrating one embodiment of the spatial pressure control algorithm according to one embodiment of the present invention.

In the previous algorithm of FIG. 14, the pressure is varied spatially across the die. From the results, we came to an understanding that, this variation of pressure would only help us achieve a uniform upper surface. This means, we cannot control the step height to achieve planarity. It is found that, at very low pressures, the removal rate of the lower surface is negligible. This criteria, is used as the basis for controlling step height. An algorithm is devised in such a way that, minimum pressures are applied in a proportional way across the die, over the n zones, such that both global and local step heights are minimized.

Figure 15:
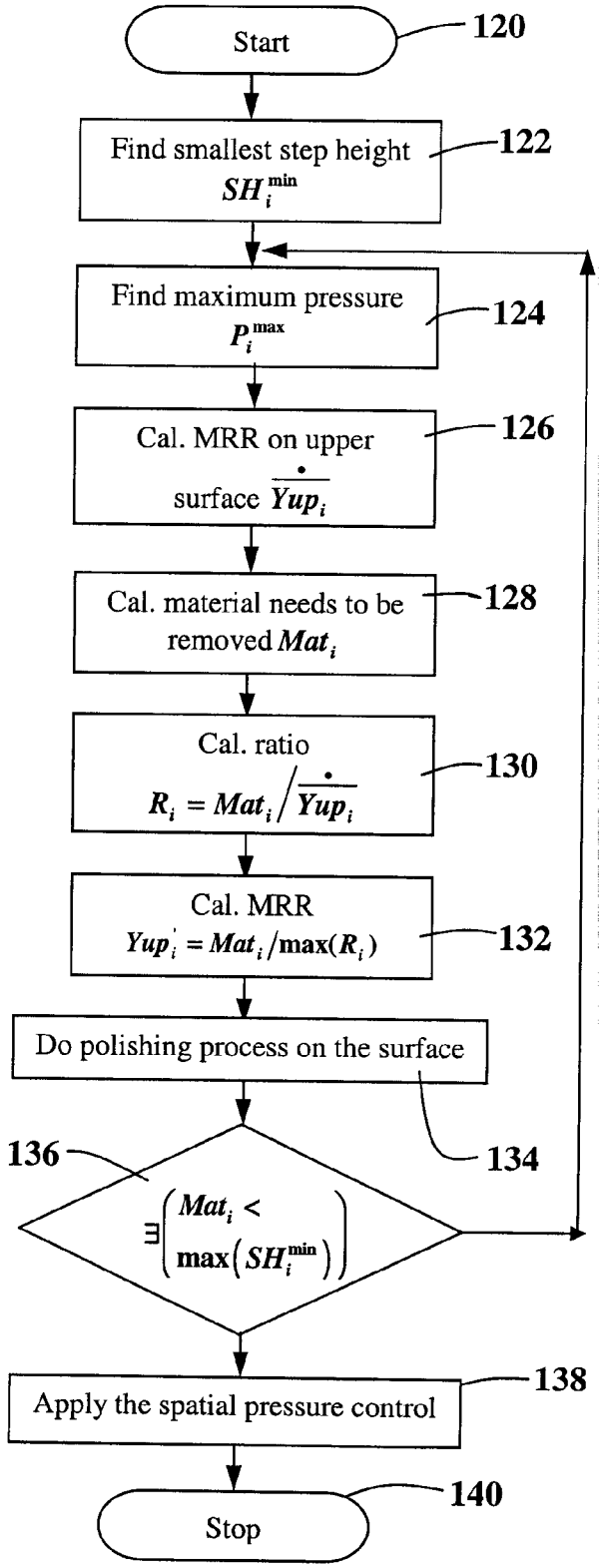
FIG. 15 is a flow chart illustrating one embodiment of the spatial and temporal pressure control according to one embodiment of the present invention.

This control is divided into two phases. In the first phase, the surface is polished using low interface pressure for controlling the local step height. By using this low pressure, only the upper surface is polished, while the lower surface remains the same. After the height difference between upper and lower surface reaches its limitation point, depending on the surface topography and the pad properties, this phase will no longer exist. In order to control the global step height, the second phase is presented. The applied interface pressures are calculated using spatial pressure control for each of the n zones based on the present upper surface evolution from the previous phase. FIG. 15 illustrates one embodiment of such an algorithm that provides for both spatial and temporal pressure control.

Step 120. The algorithm starts.

Step 122. Calculate Minimum Step height. From the machine specifications, the minimum interface pressure capability is calculated. And with that pressure as the applied pressure, the smallest step height achievable (such that only the upper surface is polished) for each zone ($SH_i^{min}$) is calculated. One example of an appropriate expression is:

$$\frac{dY_{lower}}{dt}(P_{min})=0 \Rightarrow SH_1^{min}, SH_2^{min}, SH_3^{min}\ldots$$

where $P_{min}$ is the minimum pressure capability for a specific CMP machine

Step 124. Calculate Max pressure. With the respective step heights of each zone, the maximum pressure that can be applied is calculated for each zone ($P_i^{max}$) such that only the upper surface is polished and the lower surface is left untouched. An appropriate expression is:

$$\frac{dY_{lower}}{dt}(SH_i)=0 \Rightarrow P_1^{max}, P_2^{max}, P_3^{max}\ldots$$

where $SH_i$ is the present step height of i-th zone

Step 126. Calculate material removal rate on the upper surface of each zone $\overline{Y'_{upper_i}}$ with $P_i^{max}$.

Step 128. Calculate material need to be removed of each zone ($Mat_i$) by setting $$Mat_i=SH_i-\max(SH_i^{min})$$

Step 130. Calculate the ratio ($R_i$) by setting $$R_i=\frac{Mat}{Y'_{upper_i}}$$

Step 132. Assuming relation between step height and time to be linear, calculate the material removal rate on the upper surface $$Y'_{upper_i}=R_i=\frac{Mat_i}{\text{Max}(R_i)}$$

Then, calculate interface pressure ($P_i$) and material removal rate on the lower surface, $Y'_{lower_i}(t)$.

Step 134. Polish. Now using removal rate equations 4 and 5, the polishing is carried out on the wafer surface Step 136. Check. Repeat steps 124 to 136 until the following condition is satisfied. The condition helps, finding out whether the surface has reached the least step height $SH_1^{min}$ $$\exists(Mat_i<\max(SH_i^{min})),\ \text{for i=1 to n (\# of zones)}$$

Step 138. Spatial pressure control. After reaching the stipulated step height, now the spatial pressure control algorithm is applied to attain the target surface.

Step 140. Stop. The algorithm has been completed.

By using the spatial and temporal pressure control, the step height is first reduced. Then to attain the target surface, the spatial pressure algorithm is applied over this newly evolved surface. It should be noted that, the removal rate equations follow a polishing process such that the time step is 1 sec. So for every second, the steps 124 to 136 will be repeated, which is not practically applicable. The following algorithm provides a solution to this issue.

Look-Ahead Scheduled Pressure Control Method

Figure 16:
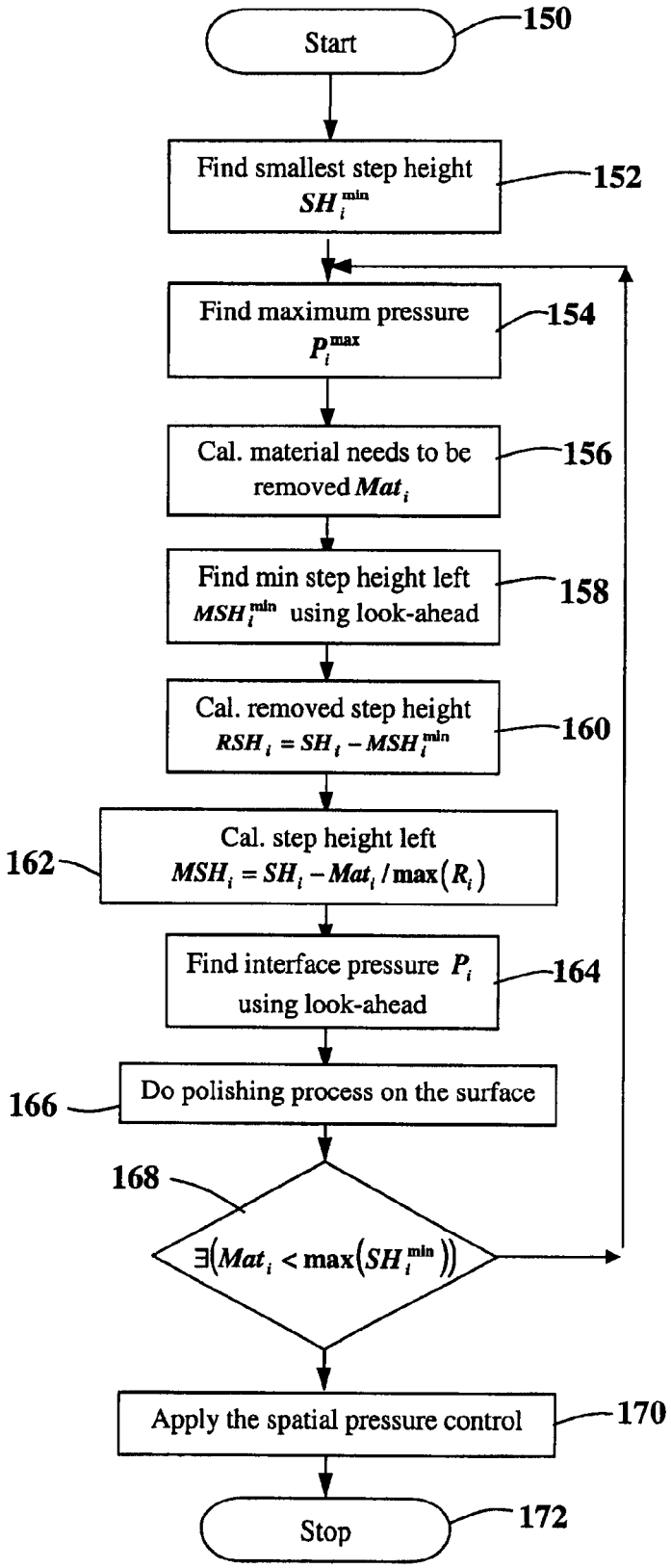
FIG. 16 is a flow chart illustrating one embodiment of the look ahead scheduled pressure control algorithm according to one embodiment of the present invention.

FIG. 16 provides a flow chart showing one embodiment of a look-ahead scheduled pressure control algorithm of the present invention. The possibility of changing the applied pressure for every one second is indeed impractical. The look ahead pressure control algorithm is programmed such that, the time step is user controlled. Here, the step height to be formed when applied a specific set of pressure values across 'n' zones is viewed ahead of the process and the pressure is modified again based on the desired step height. The time for look ahead is equal to the time step selected.

Step 150. The algorithm starts.

Step 152. Calculate Minimum step height. From the machine specifications, the minimum pressure capability is calculated. And with that pressure as the applied pressure, the smallest step height achievable (such that only the upper surface is polished) for each zone ($SH_i^{min}$) is calculated.

$$\frac{dY_{lower}}{dt}(P_{min}) = 0 \Rightarrow SH_1^{min}, SH_2^{min}, SH_3^{min} \ldots$$

where $P_{min}$ is the minimum pressure capability for a specific CMP machine

Step 154. Calculate Max Pressure. With the respective step heights of each zone, the maximum pressure that can be applied is calculated for each zone ($P_i^{max}$) such that only the upper surface is polished and the lower surface is left untouched.

$$\frac{dY_{lower}}{dt}(P_{min}) = 0 \Rightarrow P_1^{max}, P_2^{max}, P_3^{max} \ldots$$

where $SH_i$ is the present step height of i-th zone

Next steps are performed which provide results used in calculating the interface pressure for each zone ($P_i$).

Step 156. Calculate material needed to be removed ($Mat_i$). The material to be removed (in terms of length) from each zone ($Mat_i$) is calculated. The reason that the biggest step height is taken into consideration is that, its assumed that while polishing we always try to follow the un said rule that, its better to remove less than the actual, rather than removing more.

$$Mat_i = SH_i - \max(SH_i^{min})$$

Step 158. Find minimum step height left using look ahead. With $P_{min}$ and $P_i^{max}$ as inputs for each zone, the minimum possible step height left is identified in each zone after a specific period of time using a look-ahead procedure $$\text{Look-ahead}(t, P) \Rightarrow MSH_1^{min}, MSH_2^{min}, MSH_3^{min} \ldots$$

Figure 4:
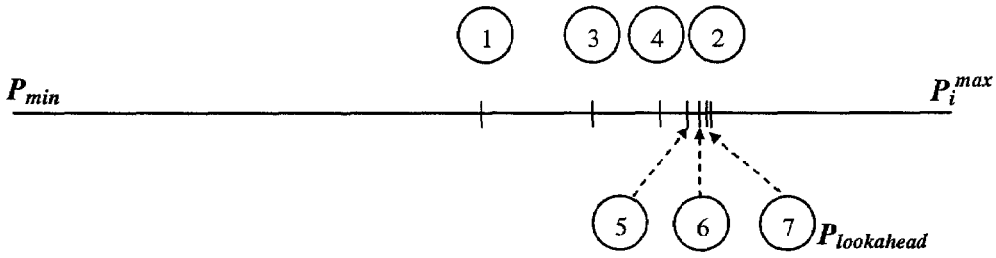
FIG. 4 is a pressure selection loop.
Figure 5:
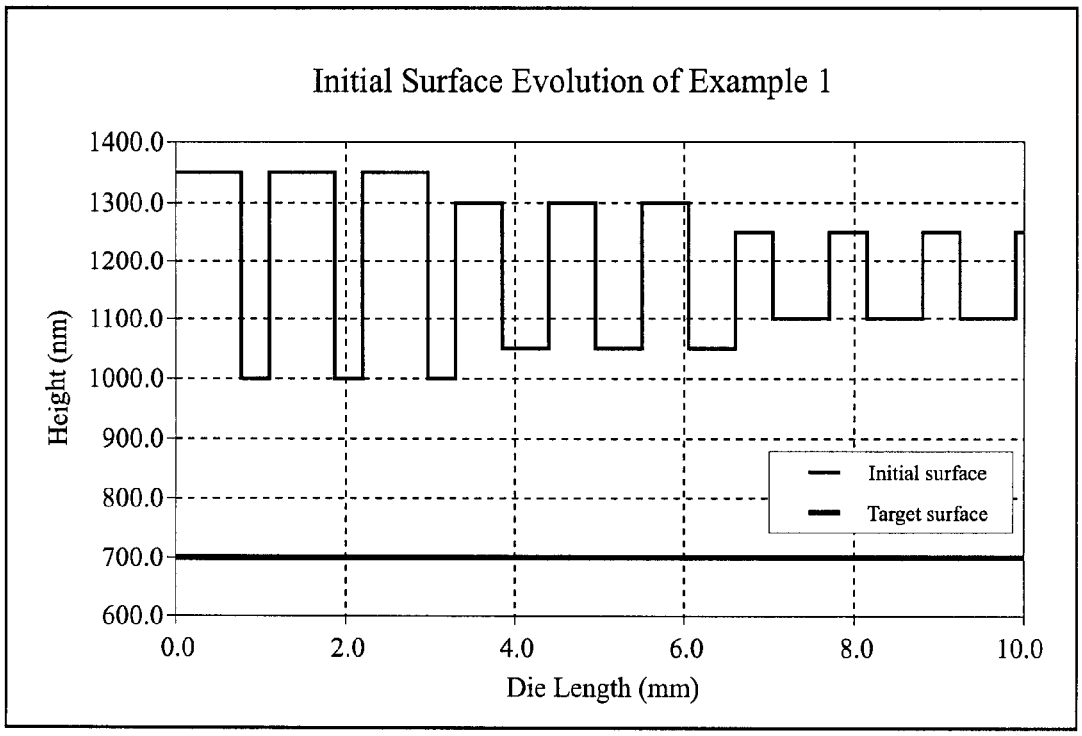
FIG. 5 illustrates an initial or starting surface in relation to a target surface.
Figure 6:
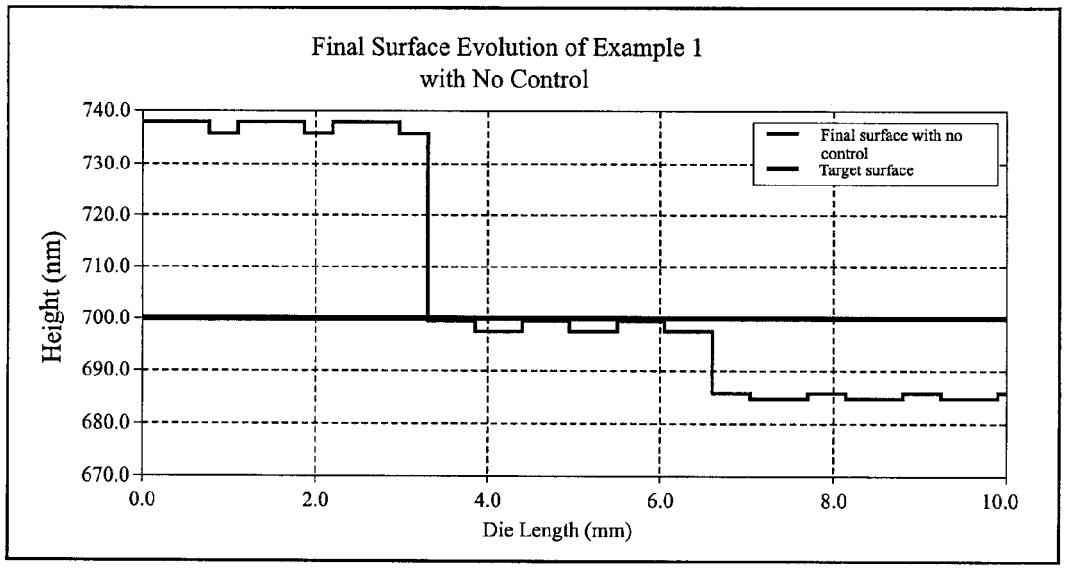
FIG. 6 illustrates a final surface where no control algorithm has been used. Note the variation in height, both above and below the target surface.
Figure 7:
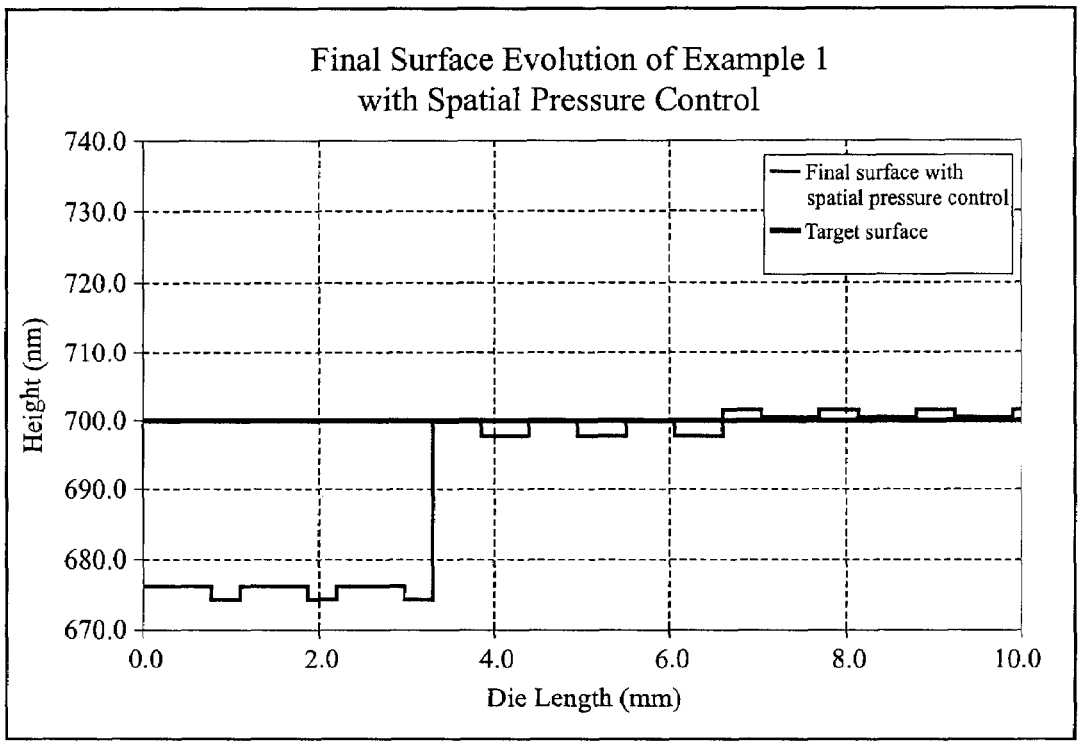
FIG. 7 illustrates a final surface after applying a spatial pressure control algorithm of the present invention. Note improved regularity in height relative to FIG. 6.
Figure 8:
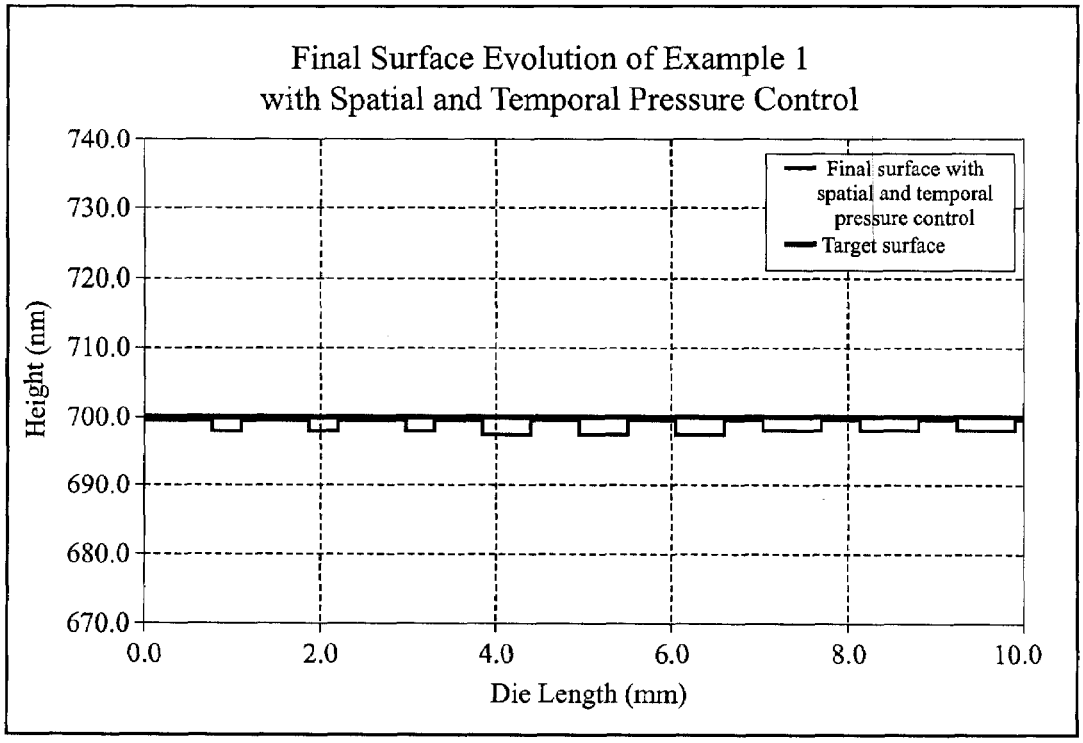
FIG. 8 illustrates a final surface after applying a spatial and temporal pressure control algorithm of the present invention. Note that only small variations in height are present between the final surface and the target surface.
Figure 9:
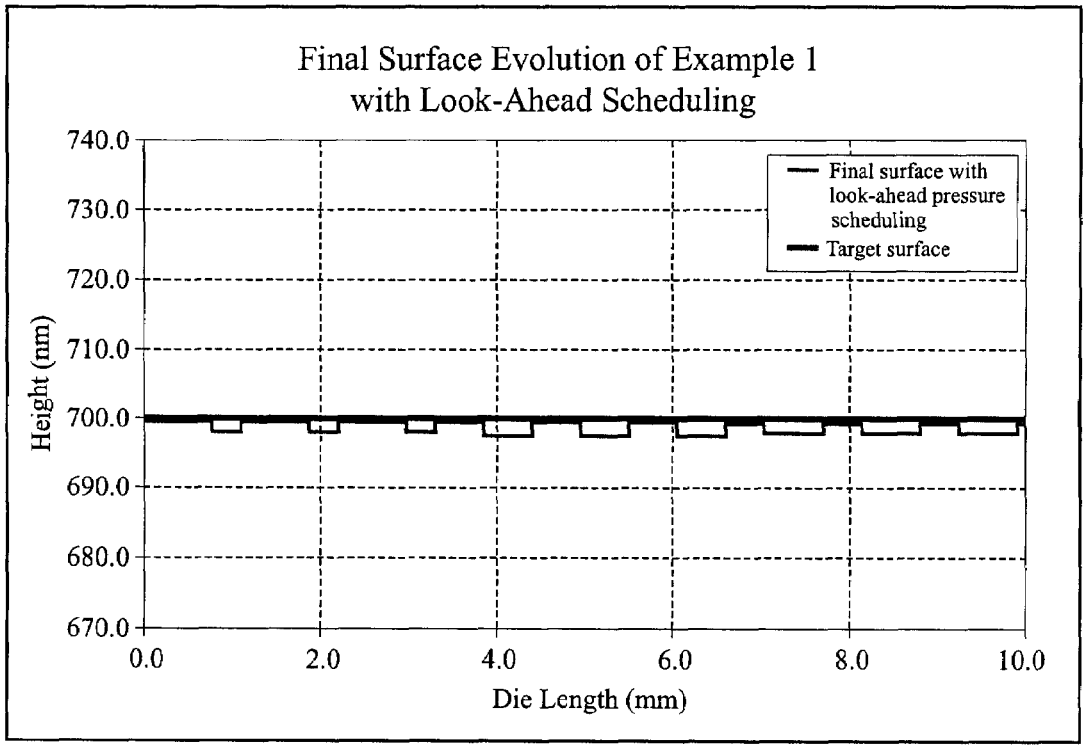
FIG. 9 is a final surface after applying a look-ahead scheduled pressure control algorithm of the present invention. Note that only small variations in height are present between the final surface and the target surface.
Figure 10:
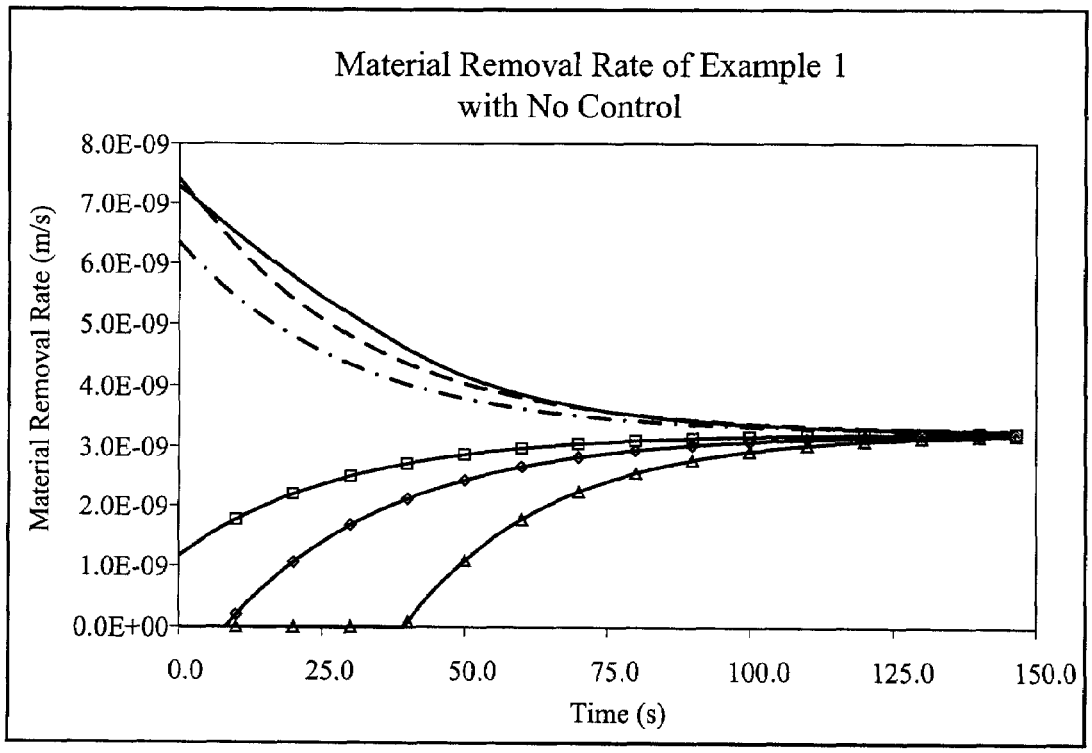
FIG. 10 is a graph illustrating material removal rate versus time where no control algorithm is used.
Figure 11:
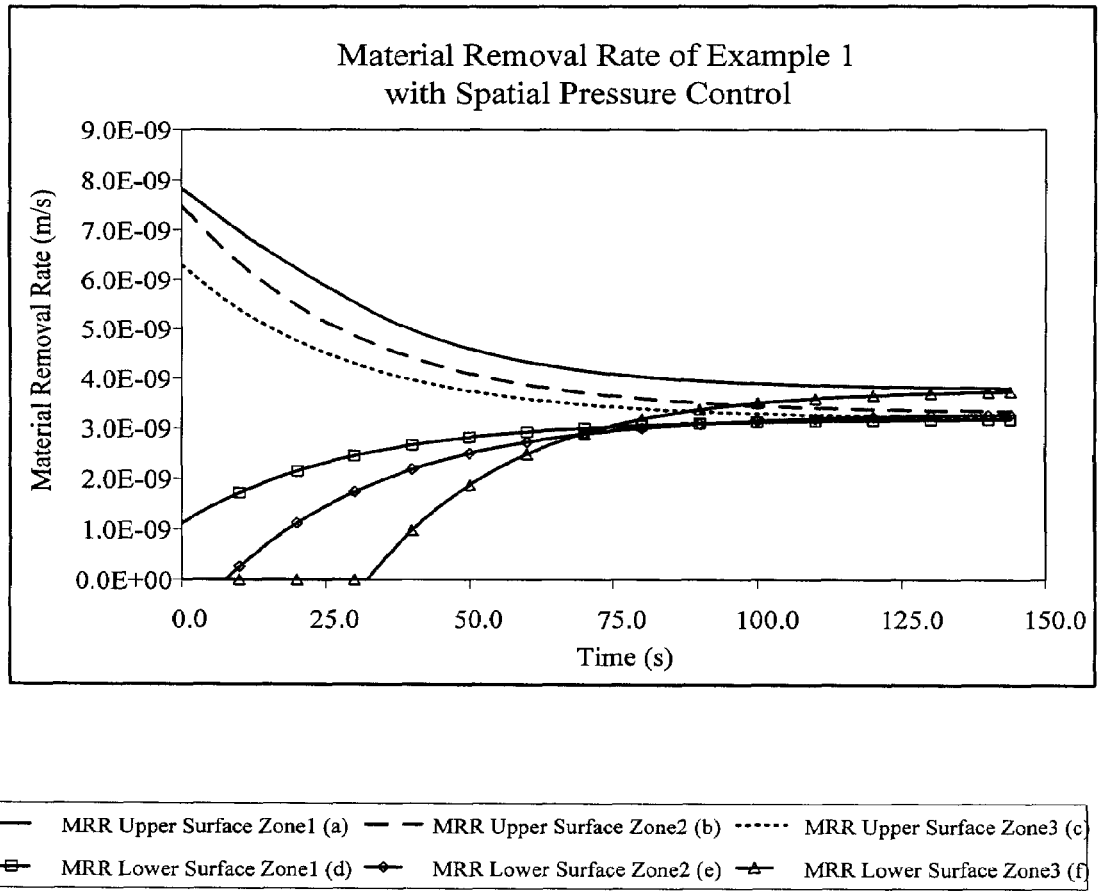
FIG. 11 is a graph illustrating material removal rate versus time where the spatial pressure control algorithm is used.

The look ahead procedure (t, P) may be performed by calculating a first step height after specific time for two interface pressures, ($P_1$, $P_2$). Next, a second step height is calculated after a specific time for interface pressure $(P_1+P_2)/2$. Next, the procedure compares the second step height to the first step height and substitutes the pressure associated with the second step height to one of the pressures used in calculating the first step height in order to get new ($P_1$, $P_2$). This procedure is then repeated until $P_2-P_1<0.1\times P_{min}$ for minimum possible step height left $MSH_i^{min}$ FIG. 4 provides a schematic diagram which shows the way in which the next pressure value is selected. With $P_{min}$ and $P_i^{max}$ as inputs, the minimum step heights are calculated. The next pressure is selected and the procedure is performed again.

Of course, the present invention contemplates variations in the look ahead procedure used in finding the minimum step height in step 158 of FIG. 15.

Step 160. Calculate removed step height. The step height that is to be removed or polished from each zone is calculated after the specific time $$RSH_{i=SHi} - MSH_i^{min}$$

Step 162. Calculate the step high left. The ratio is calculated as follows $$R_i = \frac{Mat_i}{RSH_i}$$

Calculate the material to be removed from each zone, based on zonal ratio, that should occur by setting $$LSH_i = Mat_i / \max(R_i)$$

Step 164. Find interface pressure, $P_i$, using look-ahead. Find the interface pressure of each zone using look-ahead procedure for $MSH_i$ (the step height to be left after the prescribed time step)

$$MSH_i = SH_i - LSH_i \text{Look-ahead}(t, MSH_i) \Rightarrow P_1, P_2, P_3 \ldots$$

The look ahead procedure (t, $MSH_i$) may be performed by calculating a first step height after a specific time for two interface pressures ($P_1$, $P_2$). Next, a second step height is calculated after specific time for interface pressure $(P_1+P_2)/2$. Next the look ahead procedure compares the second step height to the first step height and substitutes the pressure associated with the second step height to one of the pressures associated with the first step height to get new ($P_1$, $P_2$). The procedure then repeats until $P_2-P_1<0.1\times P_{min}$ such that the step height left is equal to $MSH_i$ Of course, the present invention contemplates variations in the look ahead procedure used in finding the minimum step height in step 164 of FIG. 16.

Step 166. Polish. Now using removal rate equations 4 and 5, the polishing is carried out on the wafer surface Step 168. Check. Repeat step 154 to 168 until the following condition is satisfied. The condition assists in determining whether the surface has reached the least step height $SH_1^{min}$ $$\exists(Mat_i < \max(SH_i^{min}))$$

Step 170. Spatial pressure control. After reaching the stipulated step height, now the spatial pressure control algorithm is applied to attain the target surface.

Step 172. The process is complete.

Simulation Results

In order to aid in the understanding of the control algorithms described, a simulation example based on experimental data is provided. Table 1 has the examples which are taken into consideration for checking the algorithm. It is assumed that the die has 3 different pattern densities, and hence divided into 3 zones. The table has the upper and lower surface heights for each zones. In the first and third example, the heights and pattern densities are reversed. Example 2 and 4 are random variations and they lie along the value range of 1 and 3.

The constants are [Stavreva et al 1997]

| | | |
|---|---|---|
| K | Preston's constant = | $1.566 * 10^{-13}$ $m^2/N$ |
| k | Stiffness = | $8.027 * 10^{10}$ $N/m^3$ |

-continued

| | | |
|---|---|---|
| α | Bending factor = | $2.16 * 10^6$ N/m |
| V | Velocity = | 0.5 m/s |

TABLE 1

Example sets

| | Example 1 | | | Example 2 | | | Example 3 | | | Example 4 | | |
|---|---|---|---|---|---|---|---|---|---|---|---|---|
| Zone | Initial $Y_{upper}$ (nm) | Initial $Y_{lower}$ (nm) | a/b | Initial $Y_{upper}$ (nm) | Initial $Y_{lower}$ (nm) | a/b | Initial $Y_{upper}$ (nm) | Initial $Y_{lower}$ (nm) | a/b | Initial $Y_{upper}$ (nm) | Initial $Y_{lower}$ (nm) | a/b |
| 1 | 1350 | 1000 | 0.3 | 1250 | 1000 | 0.3 | 1250 | 1100 | 0.3 | 1350 | 1000 | 0.3 |
| 2 | 1300 | 1050 | 0.5 | 1300 | 1050 | 0.5 | 1300 | 1050 | 0.5 | 1400 | 1250 | 0.5 |
| 3 | 1250 | 1100 | 0.6 | 1350 | 1100 | 0.6 | 1350 | 1000 | 0.6 | 1300 | 1150 | 0.6 |

TABLE 2

Results for example 1.

| | No control | | | Spatial Pressure Control | | | Spatial and Temporal Pressure Control | | | Look-Ahead Pressure Scheduling | | |
|---|---|---|---|---|---|---|---|---|---|---|---|---|
| Example 1 Zone | Final $Y_{upper}$ (nm) | Final $Y_{lower}$ (nm) | Final SH (nm) | Final $Y_{upper}$ (nm) | Final $Y_{lower}$ (nm) | Final SH (nm) | Final $Y_{upper}$ (nm) | Final $Y_{lower}$ (nm) | Final SH (nm) | Final $Y_{upper}$ (nm) | Final $Y_{lower}$ (nm) | Final SH (nm) |
| 1 | 737.9 | 735.8 | 2.067 | 676.2 | 674.3 | 1.877 | 699.5 | 697.9 | 1.555 | 699.5 | 698.0 | 1.550 |
| 2 | 699.5 | 697.5 | 2.052 | 699.8 | 697.7 | 2.073 | 699.5 | 697.4 | 2.079 | 699.5 | 697.5 | 2.067 |
| 3 | 685.7 | 684.7 | 1.032 | 701.5 | 700.5 | 1.042 | 699.5 | 698.0 | 1.425 | 699.3 | 697.9 | 1.408 |
| Time (s) | 144.1 with 6.1 psi | | | 143.8 with 7 psi | | | 145.8 | | | 145.0 | | |
| % Error | 8.108 | — | — | 3.923 | — | — | 0.231 | — | — | 0.262 | — | — |
| Stdev | — | — | 0.593 | — | — | 0.548 | — | — | 0.346 | — | — | 0.347 |

TABLE 3

Results for example 2, 3 and 4

| | No control | | | Spatial Pressure Control | | | Spatial and Temporal Pressure Control | | | Look-Ahead Pressure Scheduling | | |
|---|---|---|---|---|---|---|---|---|---|---|---|---|
| Zone | Final $Y_{upper}$ (nm) | Final $Y_{lower}$ (nm) | Final SH (nm) | Final $Y_{upper}$ (nm) | Final $Y_{lower}$ (nm) | Final SH (nm) | Final $Y_{upper}$ (nm) | Final $Y_{lower}$ (nm) | Final SH (nm) | Final $Y_{upper}$ (nm) | Final $Y_{lower}$ (nm) | SH (nm) |
| Example 2 | | | | | | | | | | | | |
| 1 | 687.9 | 687.0 | 0.835 | 688.6 | 687.8 | 0.836 | 699.7 | 698.7 | 1.050 | 699.8 | 698.8 | 0.944 |
| 2 | 699.5 | 698.0 | 1.498 | 699.5 | 698.0 | 1.498 | 699.6 | 698.1 | 1.555 | 699.5 | 698.1 | 1.393 |
| 3 | 726.8 | 725.5 | 1.233 | 702.1 | 700.9 | 1.231 | 699.5 | 698.0 | 1.425 | 699.5 | 698.2 | 1.276 |
| Time (s) | 153.8 with 5.7 psi | | | 153.8 with 6 psi | | | 152.1 | | | 155.0 | | |
| % Error | 7.164 | — | — | 2.545 | — | — | 0.218 | — | — | 0.218 | — | — |
| Stdev | — | — | 0.334 | — | — | 0.333 | — | — | 0.262 | — | — | 0.233 |
| Example 3 | | | | | | | | | | | | |
| 1 | 730.4 | 730.0 | 0.407 | 701.6 | 701.3 | 0.384 | 699.4 | 698.4 | 1.010 | 699.5 | 698.5 | 0.946 |
| 2 | 699.5 | 698.0 | 1.498 | 699.6 | 698.1 | 1.436 | 699.3 | 697.6 | 1.724 | 699.6 | 698.0 | 1.615 |
| 3 | 660.4 | 658.6 | 1.791 | 692.3 | 690.6 | 1.739 | 699.6 | 697.9 | 1.689 | 699.7 | 698.2 | 1.572 |
| Time (s) | 153.8 with 5.7 psi | | | 155.1 with 6 psi | | | 154.5 | | | 156.0 | | |
| % Error | 12.818 | — | — | 1.764 | — | — | 0.309 | — | — | 0.218 | — | — |
| Stdev | — | — | 0.729 | — | — | 0.711 | — | — | 0.403 | — | — | 0.374 |
| Example 4 | | | | | | | | | | | | |
| 1 | 696.1 | 695.3 | 0.779 | 664.8 | 664.1 | 0.709 | 699.7 | 699.2 | 0.512 | 700.1 | 699.6 | 0.483 |
| 2 | 814.8 | 814.3 | 0.481 | 699.8 | 699.4 | 0.466 | 699.6 | 698.9 | 0.664 | 699.7 | 699.1 | 0.623 |
| 3 | 699.8 | 699.4 | 0.396 | 699.7 | 699.3 | 0.383 | 699.4 | 698.9 | 0.539 | 699.6 | 699.1 | 0.500 |

TABLE 3-continued

| | Results for example 2, 3 and 4 | | | | | | | | | | | |
|---|---|---|---|---|---|---|---|---|---|---|---|---|
| | No control | | | Spatial Pressure Control | | | Spatial and Temporal Pressure Control | | | Look-Ahead Pressure Scheduling | | |
| Zone | Final $Y_{upper}$ (nm) | Final $Y_{lower}$ (nm) | Final SH (nm) | Final $Y_{upper}$ (nm) | Final $Y_{lower}$ (nm) | Final SH (nm) | Final $Y_{upper}$ (nm) | Final $Y_{lower}$ (nm) | Final SH (nm) | Final $Y_{upper}$ (nm) | Final $Y_{lower}$ (nm) | SH (nm) |
| Time (s) | 171.8 with 5.5 psi | | | 172.8 with 6.7 psi | | | 171.8 | | | 173.0 | | |
| % Error | 18.292 | — | — | 5.492 | — | — | 0.200 | — | — | 0.123 | — | — |
| Stdev | — | — | 0.201 | — | — | 0.169 | — | — | 0.081 | — | — | 0.076 |

In the above tables, "No control" represents, applying just a uniform pressure across the die. The pressure is to be applied is calculated such that, the time taken by the no control algorithm equals the time taken by the other control algorithms. In the above tables, "Stdev" represents the standard deviation between the step height values. The error for the upper surface uniformity is calculated using the following equation:

$$\%\text{Error}_{upper} = \sum_{i=1}^{n} [(Y_{upper}(\text{final})_i - Y_{desired})/(Y_{upper}(0)_i - Y_{desired})] \times 100$$

The objective of this model is to polish the initial variable pattern density surface such that, the final surface is uniform and has the minimum possible uniform step height all across the die. Hence the error for the step height is calculated in terms of standard deviation. The results for all the sets of examples, clearly show that, there is a significant improvement in the uniformity of the upper surface when the pressure across the die is controlled spatially. But this spatial pressure control, removes the upper as well as lower surfaces at varying rates. This results in higher deviation in step heights across the die. The results for spatial and temporal control as well as look-ahead scheduling show considerable improvement for both upper surface as well as step height deviation. It is realized that the combined spatial and temporal pressure control scheme is very difficult to realize in practice. To obviate this difficulty a predictive control strategy, called the "Look-Ahead Pressure Scheduling" is introduced. The results show that both of these schemes are equally effective. The results for Example 1 are shown next. Similar results are obtained for all examples.

Figure 12:
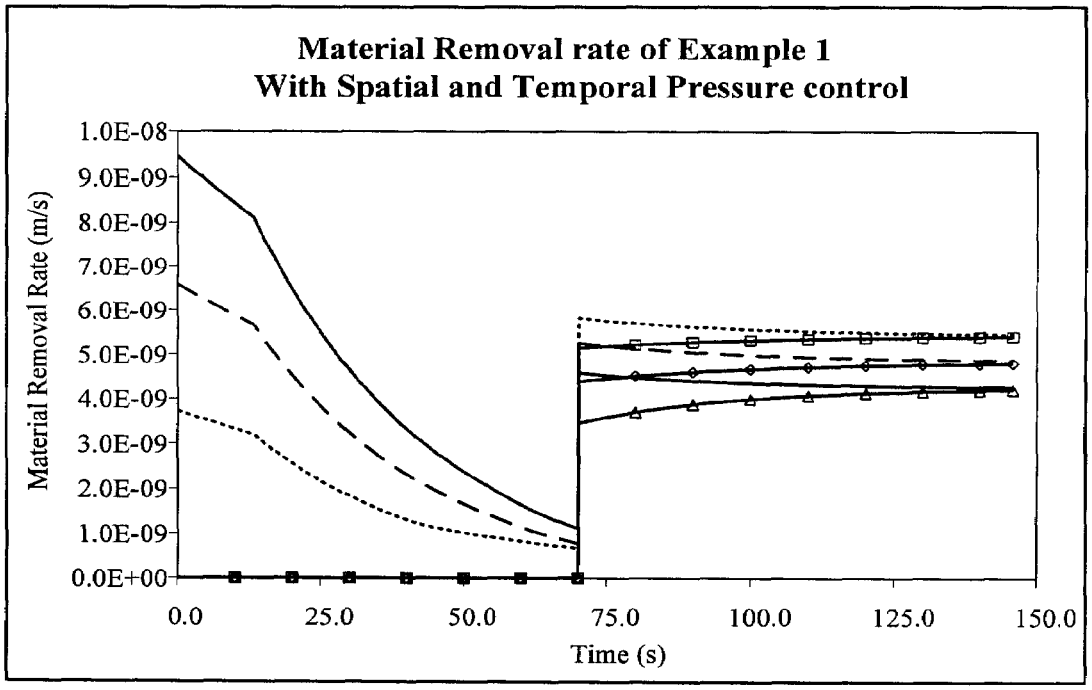
FIG. 12 is a graph illustrating material removal rate versus time where the spatial and temporal pressure control algorithm is used.

The series of graphs in the previous pages clearly show the distinctness between the various control algorithms. FIGS. 6, 7, 8, and 9 show how the uniformity of the final upper surface as well as step heights is improved from one algorithm to another. FIG. 12 shows the material removal rate variation across the entire polishing time for spatial and temporal pressure control. For the first 75 seconds, the MRR for lower surface is negligible. It is because of this reason that the step height is controlled and brought to the minimum value. For this example, the uniformity of the step height is achieved by proper variation of pressure value across the die within the first 75 seconds.

Figure 13:
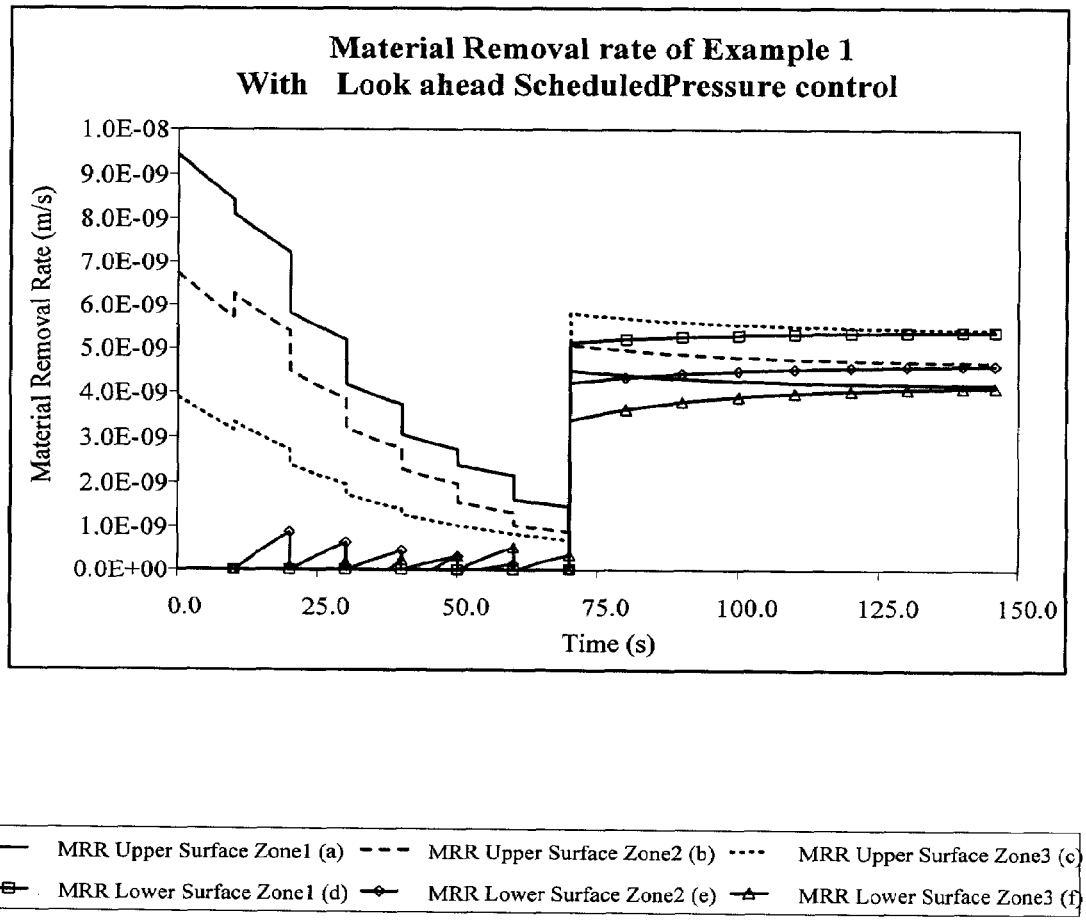
FIG. 13 is a graph illustrating material removal rate versus time where the look ahead scheduled pressure control algorithm is used.

In the look-ahead control, there is a small variation in the MRR for lower surface in the first 75 seconds. But that is the lowest possible MRR that can be achieved on the lower surface using this algorithm. The variation or the sudden change in the MRR after the first 75 seconds in FIGS. 12 and 13 is due to the change of algorithm to spatial control.

Thus, the present invention provides for improving improve the polishing mechanism to obtain better upper surface finish and more uniform step heights on wafer surfaces having variable pattern densities in die scale. The control mechanism was developed based on the fact that modifying pressure across the die over different pattern densities would in turn improve the final surface uniformity. Based on this, three different control algorithms were developed, viz. Spatial pressure control, Spatial and Temporal pressure control, and Look-ahead scheduled pressure control. The results show that these control strategies provide the opportunity to significantly enhance both the upper surface uniformity and step height in a CMP process. The present invention contemplates that in addition to controlling the pressure additional physical parameters associated with the chemical mechanical polishing or chemical mechanical planarization process may be controlled. These additional physical parameters include physical parameters between the polishing pad and wafer surface, including without limitation, velocity, temperature profile, voltage, and current.

The present invention is not to be limited to the specific embodiments presented herein. The present invention contemplates numerous variations in the specific control methodologies used, the structure used to implement the control methodologies, and other variations all of which are within the spirit and broad scope of the invention.

REFERENCES

L. M. Cook, "Chemical processes in glass polishing," *J. Non-Crystalline Solids*, vol. 120, pp. 152-171, 1990.

S. Eamkajornsiri, G. Fu, R. Narayanaswami, A. Chandra, "Simulation of wafer scale variations in CMP," *Transactions of NAMRI XXIX, SME, pp* 221-228, 2001.

G. Fu, A. Chandra, "An analytical dishing and step height reduction model for CMP", IEEE Trans. on Semiconductor Manufacturing, vol 16, pp. 477-485, 2003.

C. W. Kaanta, S. G. Bombardier, W. J. Cote, W. R. Hill, G. Kerzkowski, H. S. Landis, D. J. Poindexter, C. W. Pollard, G. H. Ross, J. G Ryan, S. Wolff, J. R. Cronin, "Dual damascene: a ULSI wiring technology," *proc. VMIC conf., pp* 144-152, 1991.

H. Kranenberg, P. H. Woerlee, "Influence of overpolish time on the performance of W damascene technology," *J. Electrochem, Soc.*, vol. 145, no. 4, pp 1285-1291, 1998.

S. H. Li, R. O. Miller, "Chemical Mechanical Polishing in Silicon Processing," *Semiconductors and semimetals*, Vol 63, Academic press, 2000.

D. O Ouma, "Modeling of Chemical Mechanical Polishing for Dielectric Planarization," PhD thesis, MIT, 1998.

D. Ouma, D. Boning, J. Chung, W. G. Easter, V. Saxena, S. Misra, A. Crevasse, Characterization and modeling of oxide CMP using planarization length and pattern density concepts," *IEEE Transactions on Semiconductor Manufacturing*, vol. 15, no. 2, 2002.

W. J. Patrick, W. L. Guthrie, C. L. Standley, P. M. Schiable, "Application Chemical Mechanical Polishing to the Fabrication of VLSI Circuit Interconnections," *Electrochem. Soc.*, Vol. 138, No. 6, pp. 1778-1784, June 1991.

F. W. Preston, "The theory and design of plate glass polishing machines," *J. Soc. Glass technol.*, vol. 11, pp. 214-256, 1927.

S. Sivaram, H. Bath, R. Leggett, A. Maury, K. Monning, R. "Interlevel Dielectrics by Chemical-Mechanical Polishing," *Solid* 91, May 1992.

Z. Stavreva, D. Zeidler, M. Plotner, K. Drescher, "Influence of process parameters on Chemical Mechanical Polishing of Copper," *Microelectronic engineering*, vol. 37-38, pp. 142-149, 1997.

J. M. Steigerwald, S. P. Murarka, R. J. Gutmann, "Chemical Mechanical Planarization of Microelectronic materials," John Wiley & Sons Pub., New York, 1997.

B. Stine, V. Mehrotra, D. Boning, J. Chung, D. Ciplickas, "A Simulation Methodology for Assessing the Impact of Spatial/Pattern Dependent Interconnect Parameter Variation on Circuit Performance," *IEDM Tech, Digest*, pp. 133-136, 1997.

T. Tugbawa, T. Park, B. Lee, D. Boning, P. Lefevre, L. Camilletti, "Modeling of pattern dependencies for multi-level Copper chemical-mechanical polishing processes," *Mat. Research Soc.*, spring meeting, 2001.

What is claimed is:

1. A method for spatial pressure control of an open loop chemical mechanical polishing process for a pattern dependant non-uniform wafer surface in a die scale wherein the die in the wafer surface have a plurality of zones of different heights and different pattern densities, comprising:

initializing a mathematical model for the open loop chemical mechanical polishing process using initial variables describing each of the plurality of zones;

calculating total material to remove in all zones together according to the mathematical model;

calculating polishing time needed for each zone to reach the desired surface with maximum interface pressure according to the mathematical model;

comparing the polishing time for all zones and finding maximum polishing time needed to have all applied interface pressure values of all zones to be less than or equal to a maximum interface pressure; and polishing of the wafer surface for the polishing time to thereby provide for reducing both local and global step height variations.

2. The method of claim 1 further comprising determining step height and determining an amount of total material left.

3. The method of claim 2 further comprising continuing polishing if the amount of total material left is more than a desired amount.

4. A method for control of an open loop chemical mechanical polishing process for a pattern dependant non-uniform wafer surface in a die scale wherein the die in the wafer surface have a plurality of zones of different heights and different pattern densities, comprising:

initializing a mathematical model for the open loop chemical mechanical process using initial variables describing each of the plurality of zones calculating a smallest step height for each of the zones using the mathematical model;

calculating a maximum pressure for each of the zones using the mathematical model;

calculating an interface pressure for each zone using the mathematical model;

polishing of the wafer surfaces until the smallest step height is reached as predicted by the mathematical model to thereby reduce local step height; and applying a spatial pressure algorithm to continued polishing of the wafer surface to reduce global step height.

5. A method for control of an open loop chemical mechanical polishing process for a pattern dependant non-uniform wafer surface in a die scale wherein the die in the wafer surface have a plurality of zones of different heights and different pattern densities, comprising:

reducing step height of the wafer in an initial polishing time period by varying pressure across the die; and applying a spatial pressure control algorithm after the initial polishing time period to reduce global step height;

wherein the spatial pressure control algorithm is applied using a mathematical model of the open loop chemical mechanical process.

6. A method for control of an open loop chemical mechanical polishing process for a pattern dependant non-uniform wafer surface in a die scale wherein the die in the wafer surface have a plurality of zones of different heights and different pattern densities, comprising:

providing initial variables describing each of the plurality of zones to a control algorithm;

varying pressure applied to the die both spatially and temporally and varying velocity between a pad and the wafer surface to reduce both local and global step height variations according to the control algorithm;

varying at least one additional variable between the pad and the wafer surface, the at least one additional variable selected from the set consisting of temperature profile, voltage, and current according to the control algorithm;

wherein the control algorithm controls the varying of the pressure, the varying of the velocity, and the varying of the at least one additional variable by applying the initial variables to a mathematical model of the open loop chemical mechanical polishing process.

7. A method for control of an open loop chemical mechanical polishing process for a pattern dependant non-uniform wafer surfaces in a die scale wherein the die in the wafer surface have a plurality of zones of different heights and different pattern densities, the method comprising varying pressure applied to the die both spatially and temporally to reduce both local and global step height variations using a mathematical model of the open loop chemical mechanical process parameterized with initial data describing the wafer surface.

8. The method of claim 7 further comprising determining a manner in which to vary pressure using the mathematical model.

9. The method of claim 8 wherein the manner in which to vary pressure uses look-ahead pressure scheduling.

10. The method of claim 8 wherein the manner in which to vary pressure includes calculating the pressure for each of the plurality of zones using the mathematical model.

11. The method of claim 8 wherein the manner in which to vary pressure includes calculating an interface pressure for each of the plurality of zones using the mathematical model.

12. The method of claim 8 wherein the manner in which to vary pressure includes modifying pressure values by identifying the step heights potentially formed after a specified time step using the mathematical model.

* * * * *